US006758422B2

(12) United States Patent
Kuo

(10) Patent No.: US 6,758,422 B2
(45) Date of Patent: Jul. 6, 2004

(54) SPOUT PLATE USED IN SPRAY HEAD OF SPRAYER

(76) Inventor: Wen-Li Kuo, 235 Chung-Ho, Box 8-24, Taipei (TW)

( * ) Notice: Subject to any disclaimer, the term of this patent is extended or adjusted under 35 U.S.C. 154(b) by 249 days.

(21) Appl. No.: 10/016,384

(22) Filed: Dec. 17, 2001

(65) Prior Publication Data

US 2003/0111564 A1 Jun. 19, 2003

(51) Int. Cl.[7] ..... B05B 1/00; B05B 1/14; A62C 2/08

(52) U.S. Cl. ..... 239/596; 602/548; 602/554; 602/556

(58) Field of Search ..... 239/596, 602, 239/533.13, 554, 556, 559, DIG. 12, 548, 106, 533.12, 600, 525, 530; 4/675, 678, 596, 605, 615, 903

(56) References Cited

U.S. PATENT DOCUMENTS 3,719,328 A * 3/1973 Hindman ..... 239/546
4,674,687 A * 6/1987 Smith et al. ..... 239/447
5,228,625 A * 7/1993 Grassberger ..... 239/558
5,316,216 A * 5/1994 Cammack et al. ..... 239/71
5,730,361 A * 3/1998 Thonnes ..... 239/106
6,209,799 B1 * 4/2001 Finkbeiner ..... 239/106
6,250,572 B1 * 6/2001 Chen ..... 239/602

* cited by examiner

*Primary Examiner*—Davis D. Hwu

(57) ABSTRACT

A spout plate used in a spray head of a sprayer includes a spout plate insertably secured at the spout end of the spray head and made from a slightly flexible rubber or plastic material such that multiple posts defining distinct water guide channels are provided annularly on the spout surface thereof. A center of the spout plate is connected to a center of the interior of the spray head. When the spout plate is insertably secured at the spout end of the front end of the spray head of the sprayer, and water flows through the interior of the spray head and flow out of the spout plate for spraying via the water guide channels of the posts provided on the spout plate, different water jets can be sprayed out from the water guide channels of the posts to thereby provide an extensive spraying area and multiple effects.

3 Claims, 10 Drawing Sheets

GIG. 2
PRIOR ART

SPOUT PLATE USED IN SPRAY HEAD OF SPRAYER

BACKGROUND OF THE INVENTION (a) Field of the invention

The present invention relates to device about sprayer, and particularly to a spout plate for a spray head of a sprayer.

(b) Description of the Prior Art

Referring to FIG. 1, a conventional water sprayer is illustrated. The water sprayer includes a spray head having a bottom end with inner threads 21 and front end serving as spout end that is fitted with an spout plate 22 the surface of which is provided with many outlet holes 221, a long tube 3 having a top section with outer threads 31 for engaging inner threads 21 of the bottom end of spray head 2; and a handle 4 connected to a bottom end of long tube 3 and having a bottom end 41 connectable to a water hose (not shown) connected to a water source and provided with a switch 42 for controlling water to flow to the sprayer. In the aforesaid structure, after the bottom end of handle 4 is connected to a water source via water hoses, a stream of water can flow via handle 4 into long tube 3 and further into spray head 2 to be discharged via outlets 221 annularly disposed in spout plate 22 at spout end of spray head 2.

Referring further to FIGS. 1, 2, 3 and 4, the spout plate 22 is mainly made from aluminum thin round plate, the surface of which is directly punched by using a plurality of punch needles to from a plurality of outlets 221 therein, and the outlet end of spray head 2 is internally provided with a retaining positioning groove 23 such that the entire outer edge of spout plate 22 can straddle and be positioned on a top side of groove 23. A front periphery 24 of spray head 2 is roll-pressed inwardly to fit and position the spout plate 22 at outlet end of the spray head 2.

As mentioned above, after the bottom end of handle 4 is connected to water source via a water hose, a stream of water can flow via the handle 4 into the long tube 3 and further into the spray head 2 to be discharged via the outlets 221 annularly disposed in the spout plate 22 at the spout end of spray head 2. If it is desired that the water out of via the outlets 221 are a very fine jets as in a gardener's sprayer, the diameter of the outlets 221 cannot be too large, and the pressure of the water stream supplied to spray head 2 cannot be too small. Otherwise, fine jets of water cannot be obtained, and the jets of water coming out via outlets 221 are disorderly and weak.

In general, when using a plurality of multiple punching needles to form through holes in a metal plate simultaneously, the largest punching depth acceptable to the punching needles cannot be larger than the thickness of the metal plate, i.e., when through holes of 1 mm-diameter are to be formed in the metal plate and punching needles of an external diameter are used for punching the metal plate, the thickness of the metal plate cannot be larger than 1 mm. Otherwise, the punching needles cannot form the holes directly. In the conventional spout plate 22 insertably mounted at the spout end of the spray head 2, since it is made from thin round aluminum plate. Although multiple punching needles can be used to punch the spout plate 22 to form multiple through holes therein, after the bottom end of the handle 4 is connected to the water supply, the water can flow via the handle 4 into the long tube 3 and further into the spray head 2 and is sprayed out via the outlets 211 in the spout plate 21 insertably mounted at the outlet end of the spray head 21. If the pressure of the water supply is strong enough, the water is sprayed out in fine water jets from the outlets 221. If the water pressure is low, fine water jets cannot be formed and the strength of the sprayed water is weak, as shown in FIG. 4.

Therefore, only if the spout plate 22 is not made from thin round aluminum plate and is made from a round metal plate of a larger thickness and formed with multiple fine water channels therein, the water can flow the sprayer via the bottom end of the handle 4 and the long tube 3 and further into the spray head 2 so as to be sprayed out from the fine water channels in the spout plate 21 insertable mounted at the spout end of the spray head 2. However, in this case, holes in the spout plate 21 cannot be simultaneously formed by using punching needles. Instead, fine water channels have to be formed by drilling the surface of the spout plate 21, which is complicated and inconvenient in manufacturing the spout plate 21.

SUMMARY OF THE PRESENT INVENTION

The object of the present invention is to provide a spout plate for a spray head of a sprayer to overcome the drawbacks of the prior art. In the improved spout plate for a spray head of a sprayer, a spout plate is in sertably secured at the spout end of the spray head and is made from a slightly flexible rubber (plastic) material by integral injection molding such that multiple posts defining distinct water guide channels are provided annularly on the spout surface thereof. A center of the spout plate is connected to the center of the interior of the spray head that is rotatably retractable and controllable. When the spout plate is insertably secured at the spout end of the front end of the spray head of the sprayer, and the sprayer is passed by water flow which flows through the interior of the spray head and flow out from the spout plate to be sprayed out via the water guide channels of the posts provided on the spout plate, distinct water jets can be sprayed out from the water guide channels of the posts to thereby provide an extensive spraying area and multiple effects.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
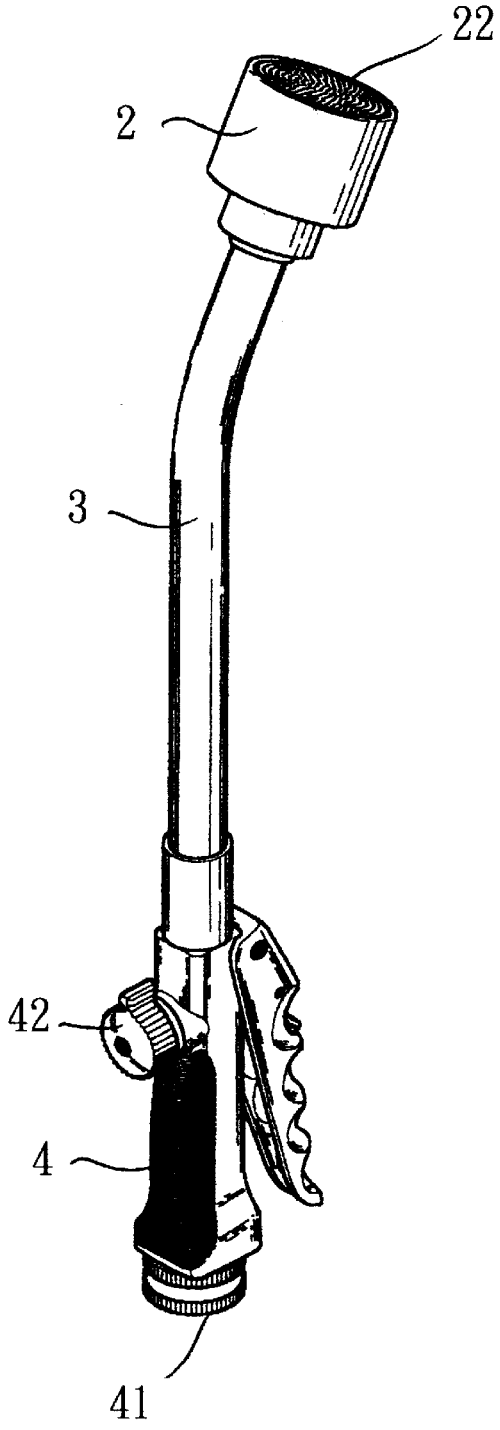
FIG. 1 PRIOR ART
FIG. 1 is a schematic perspective view of a conventional sprayer.
Figure 2:
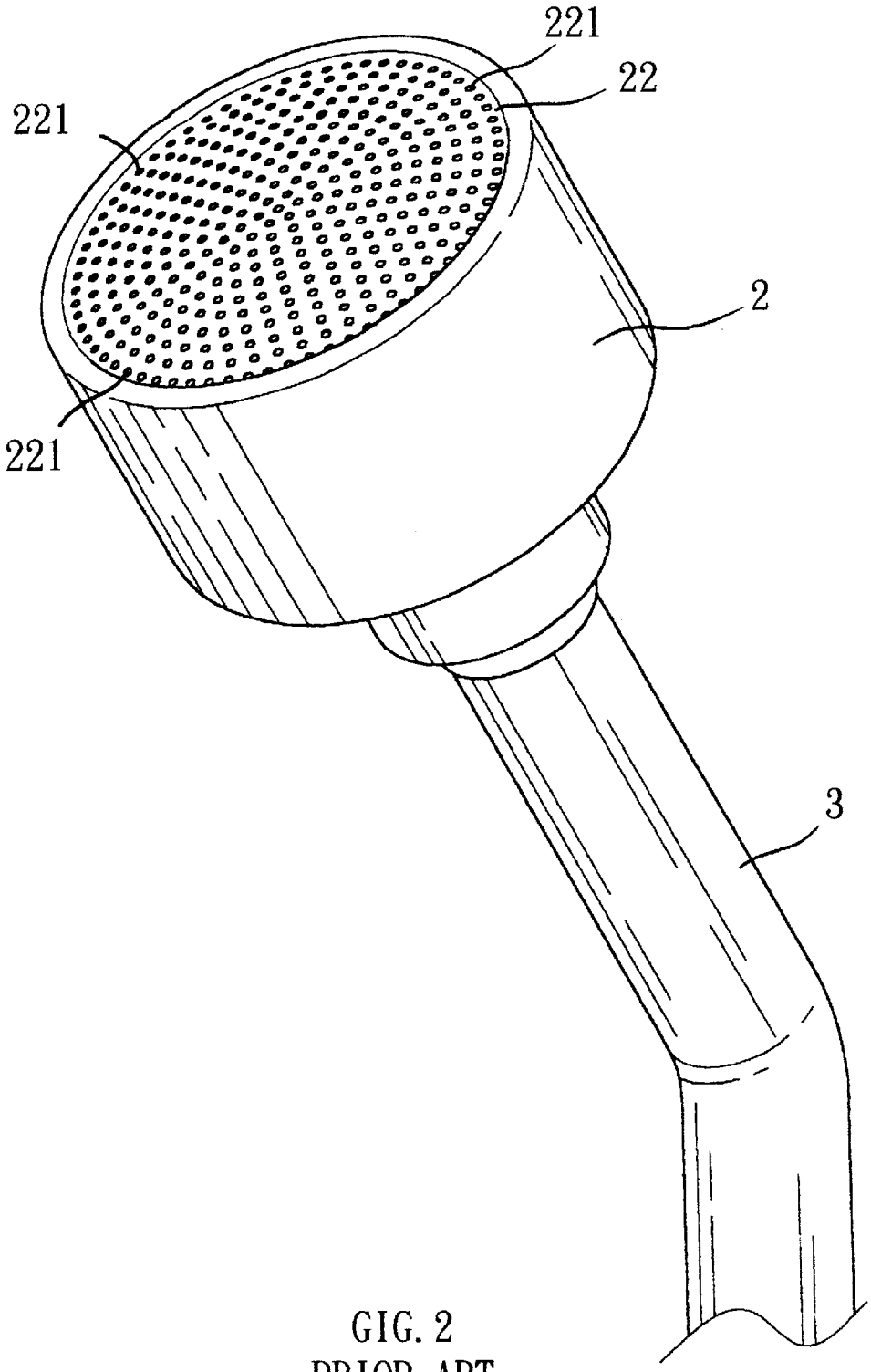
FIG. 2 is a schematic partly enlarged view of a spray head of the conventional sprayer.
Figure 3:
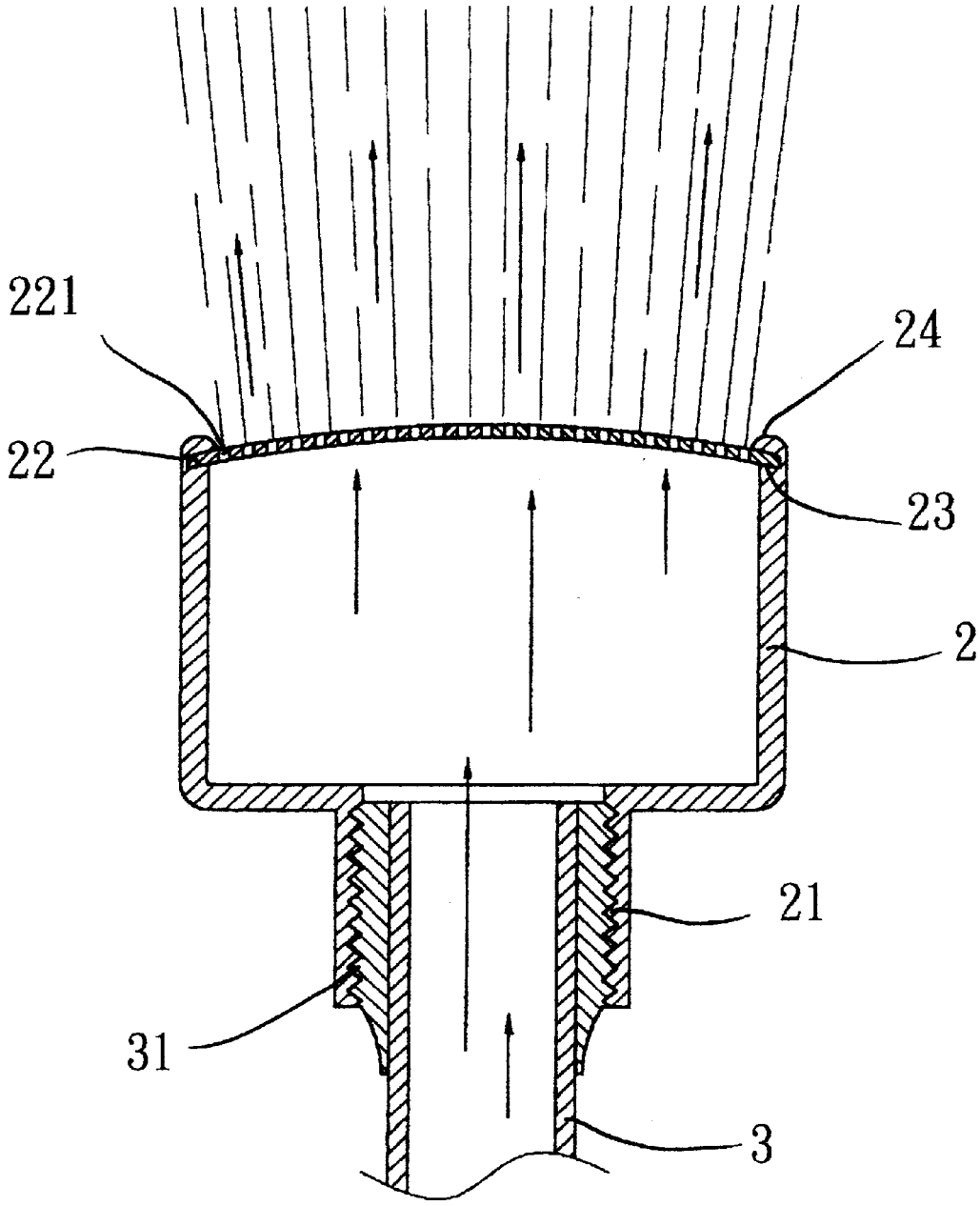
FIG. 3 PRIOR ART
FIG. 3 is a schematic sectional view of the spray head of the conventional sprayer during operation.
Figure 4:
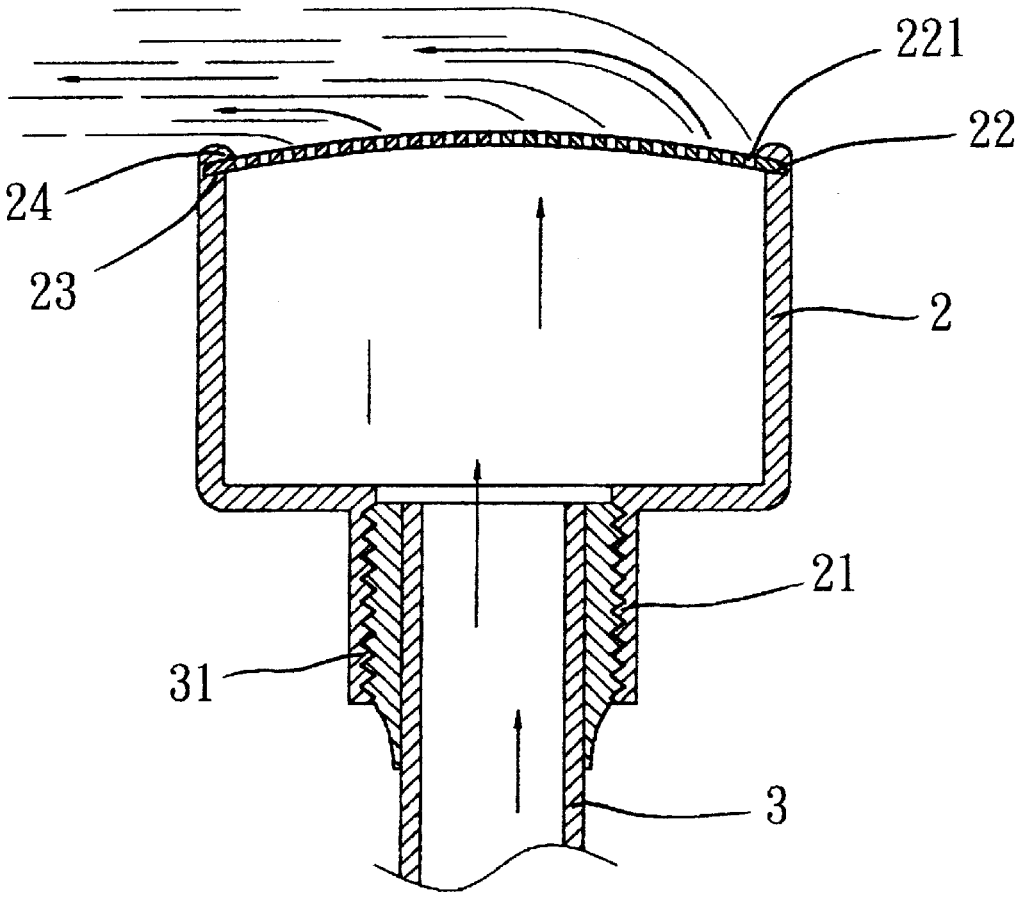
FIG. 4 PRIOR ART
FIG. 4 is a schematic section view of the spray head of the conventional sprayer during operation.
Figure 5:
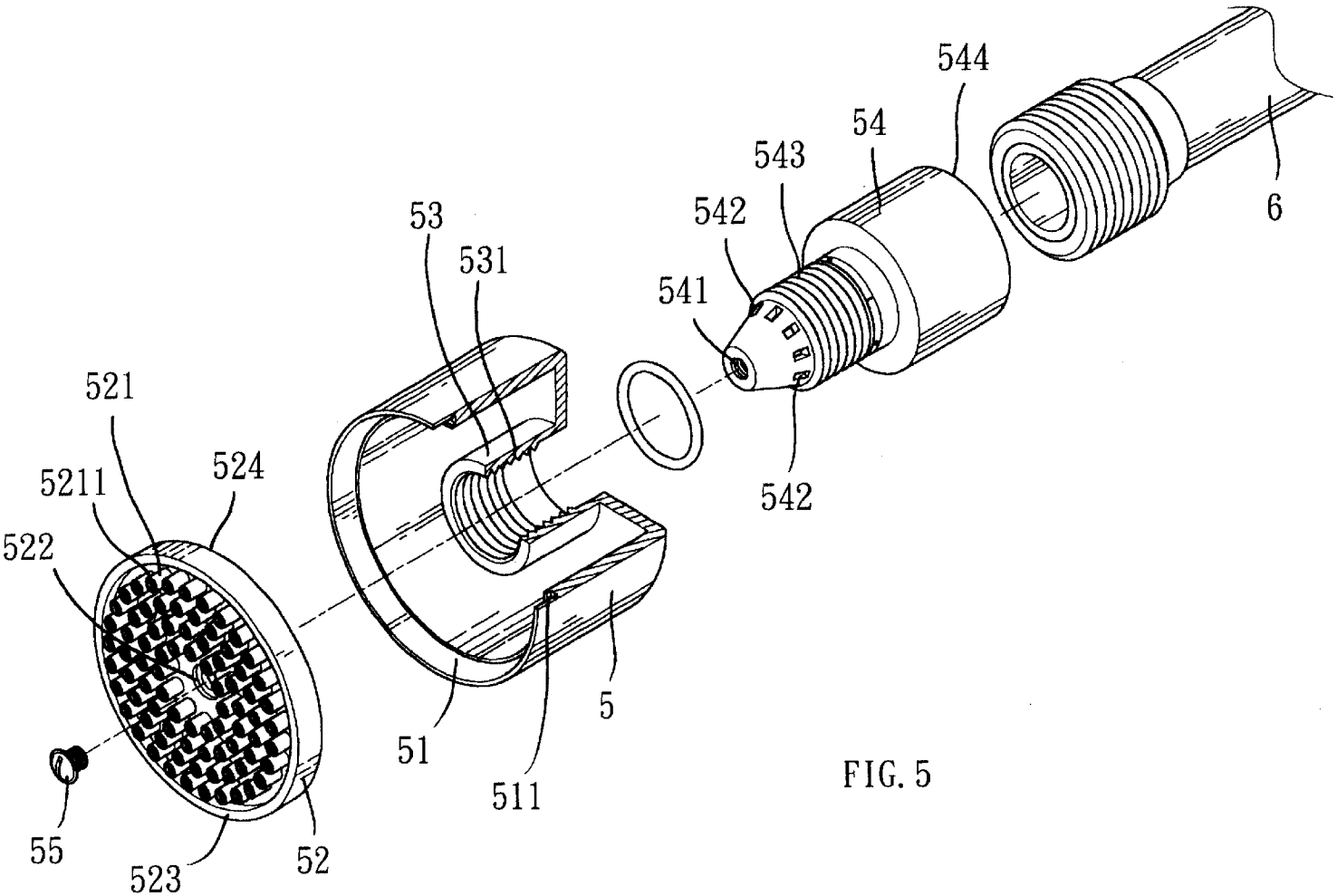
FIG. 5 is an exploded perspective view of spray head and spout plate of the conventional sprayer.
Figure 6:
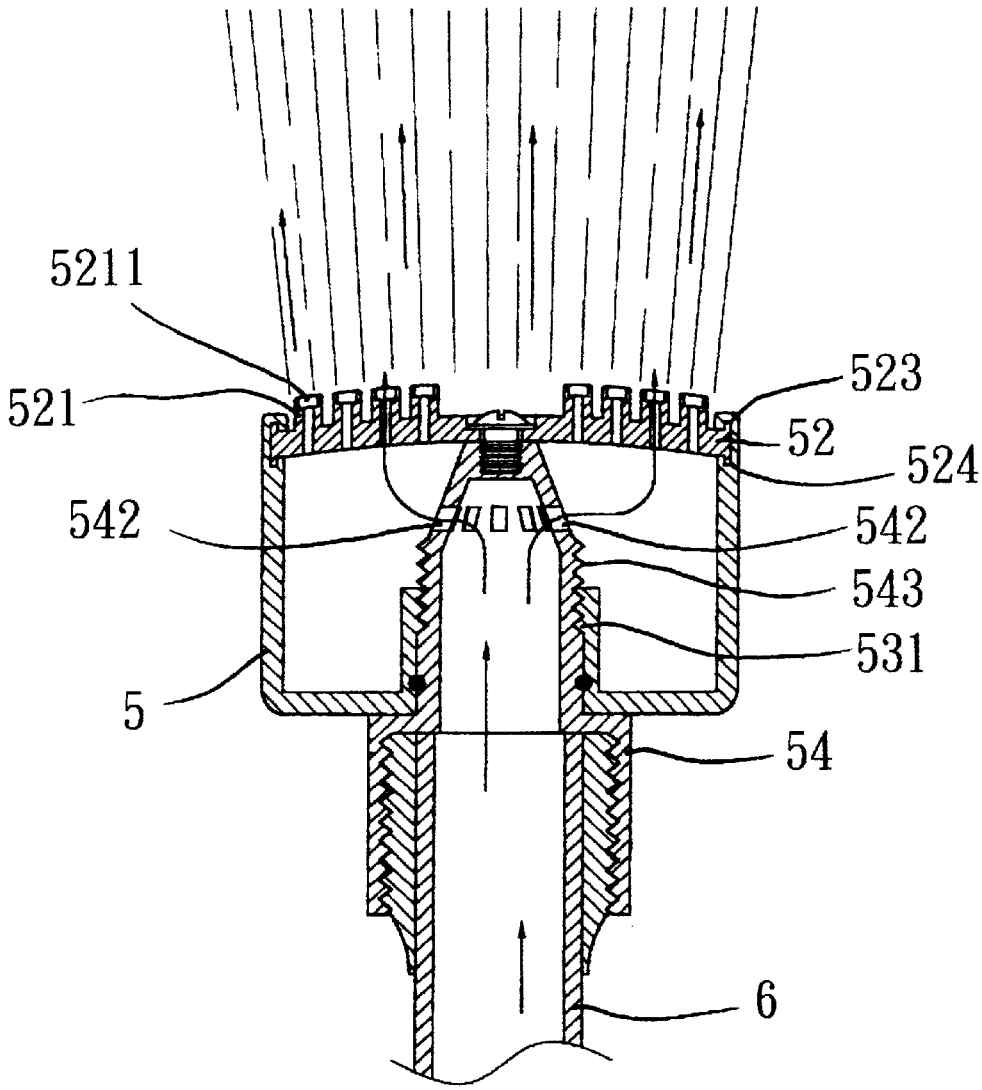
FIG. 6 is a schematic sectional view of a spray head and a spout plate of a sprayer according to the present invention, showing the spray head in a rotatably advancing state.
Figure 7:
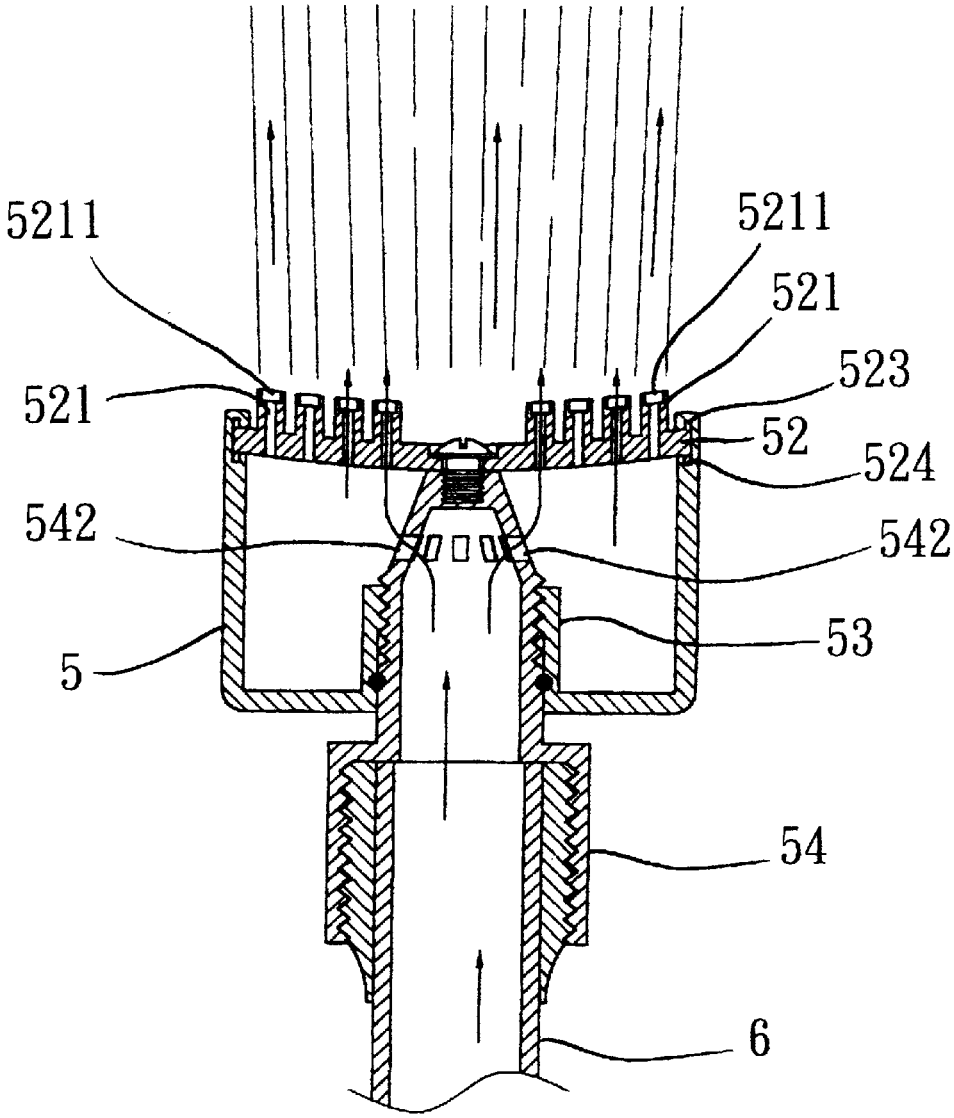
FIG. 7 is a schematic sectional view of a spray head and a spout plate of a sprayer according to the present invention, showing the spray head in a rotatably retracting state.

Referring to FIGS. 5, 6 and 7, in a spout plate for a spray head of a water sprayer of the present invention, the sprayer includes a spray head 5 having a spout end at a front end thereof and having a retaining positioning groove 51 enclosing an outer edge of a spout plate 52, a long tube 6 having a top end connected to a bottom end of spray head 5, and a handle (not shown) connected to a bottom end of long tube 6. The present invention is characterized in that the spout plate 52 insertably secured at the spout end of spray head 5 is made from a slightly flexible rubber (plastic) material by integral injection molding such that a plurality of posts 521 defining distinct water guide channels 5211 are provided annularly on the spout surface thereof. Further, the center of spout plate 52 is provided with a through hole 522. A hollow post-like flange 53 projects inwardly from the center of the water inlet end at the bottom end of spray head 5. The flange 53 has internal threads 531 for fitting a connecting member 54. The connecting member 54 has a hollow interior with a distal end centrally provided with a threaded hole 541, the periphery of a distal section thereof being provided with multiple water outlet holes 542, and the periphery of the middle section thereof being provided with external threads 543 for cooperating with flange 53 of spray head 5 to rotate forwards or rearwards. A bottom section 544 of the connecting member 54 is connected to a front end of the long tube of the sprayer. Finally, a bolt 55 passes through the through hole 522 in the center of spout plate 52 and is locked in threaded hole 541 at the distal end of connecting member 54.

After assembling the aforesaid structure, the user can control the spray head 5 to rotatably advance or retract to cause the internal threads 531 of the flange 53 at the center of the water intake end at the bottom end of spray head 5 to cooperatively rotate with external threads 543 at the outer edge of the middle section of connecting member 54. Thereby, it cause the spout plate 52 to bulge outwardly (as shown in FIG. 6) and to retract inwardly (as shown in FIG. 7), so that when the sprayer is connected to a water supply, and water flows through the spray head 5 and then is sprayed out from the spout plate 52 via the water guide channels 5211 in the posts 521, distinctly fine jets of water can be obtained to thereby provide an extensive spray area.

Figure 8:
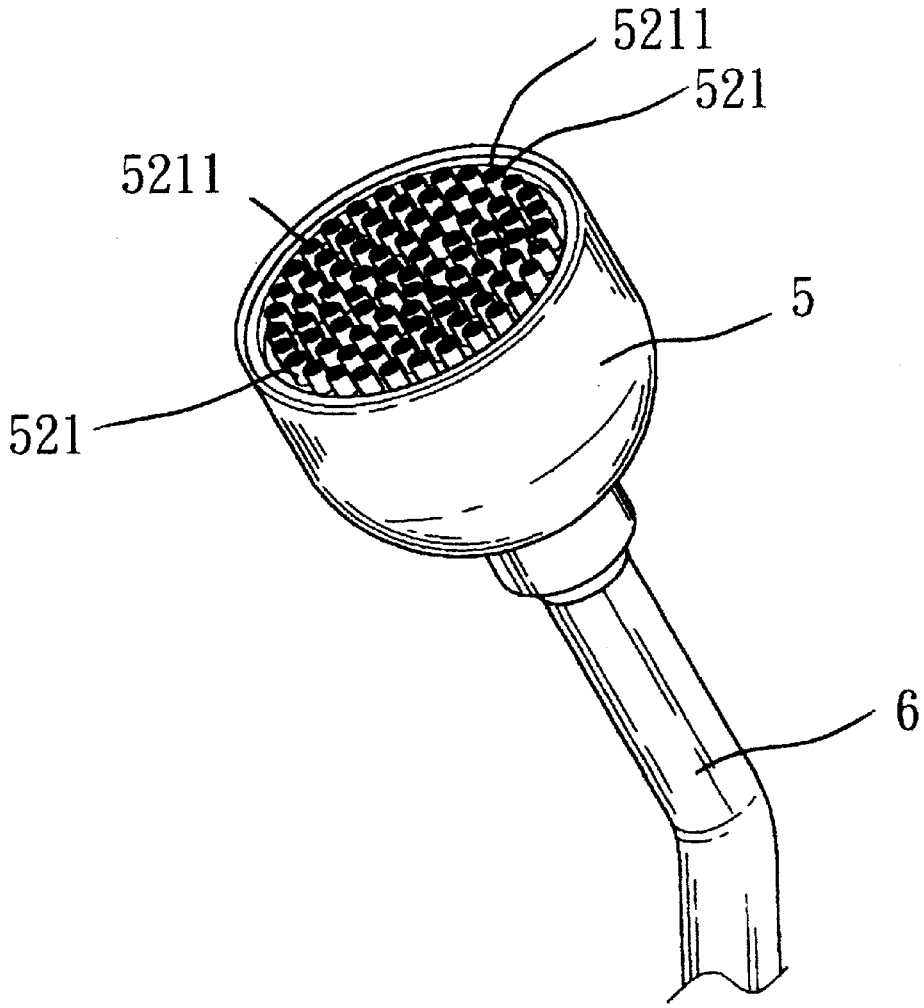
FIG. 8 is a schematic perspective view of another embodiment of the spray head and spout plate of the spray head according to the present invention.
Figure 9:
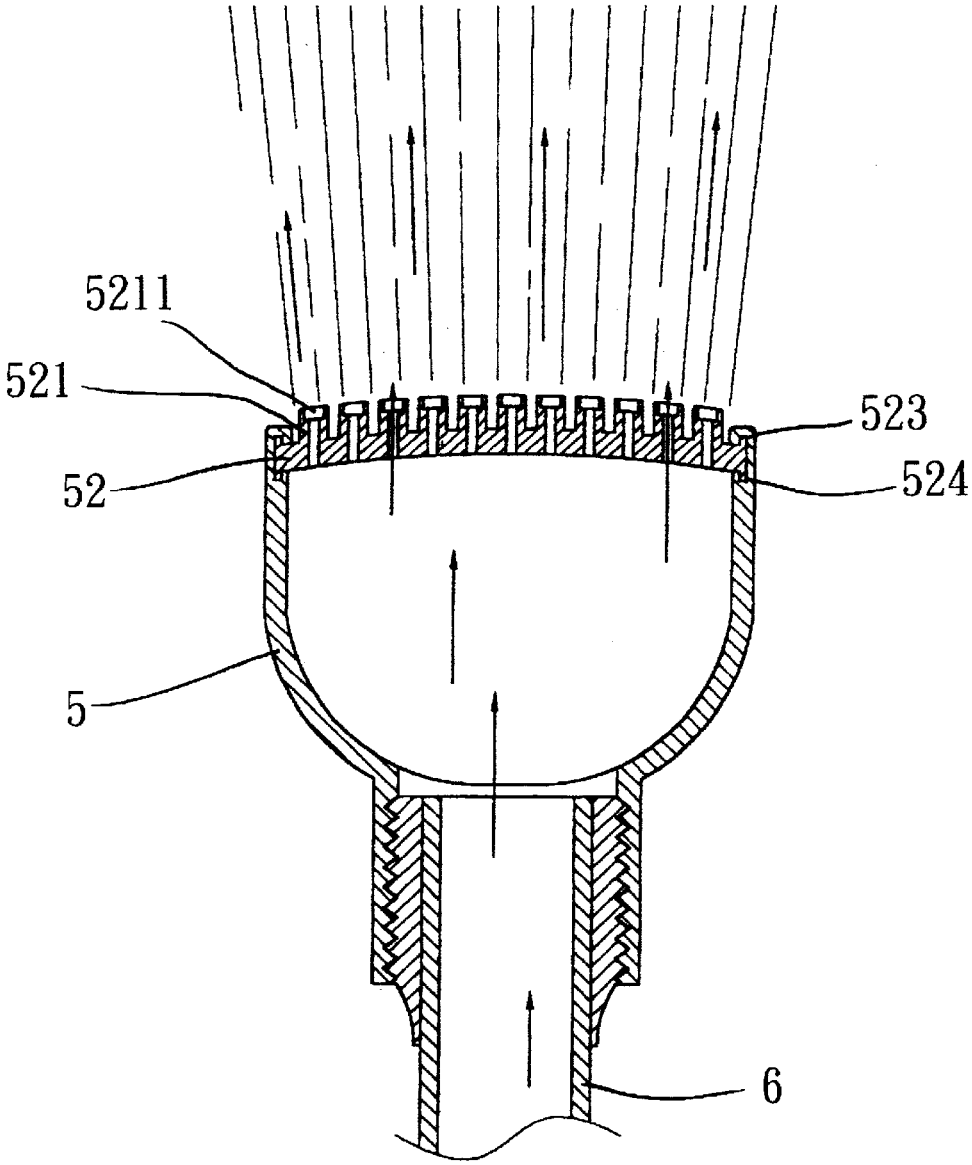
FIG. 9 is a schematic sectional view of spray head and water spout of the sprayer according to the present invention.

Referring to FIGS. 8 and 9, after forming the spout plate 52 from a slightly flexible rubber plastic) material by integral injection molding and with multiple posts 521 defining distinct water guide channels 5211, the spout plate 52 can be directly and insertably secured to the spout end at the front end of the conventional spray head 2 such that when water flows out via the spout plate 52 at the front end of the spray head 2 after water flows into the sprayer, the water jets sprayed out are distinct, thereby achieving the advantages of simple construction, convenient assembly, and low costs.

Referring to FIGS. 5 and 6 or FIGS. 8 and 9, annular flanges 523, 524 can be provided at annular edges of the top and bottom surfaces of the spout plate 52. The retaining positioning groove 51 provided in the interior of the spout end of the spray head 51 which faces the annular flange 524 provided at the annular edge of the bottom surface of the spout plate 52 is provided with an annular recess 511. As a result, when the outer edge of the spout plate 52 straddles and is positioned on the top surface of retaining positioning groove 51 of the spout end of spray head 51 and when a rolling pressure is applied to secure the spout plate 52 to the spout end of spray head 5, the spout plate 52 can be effectively and fly positioned at the spout end of the spray head 5.

Figure 10:
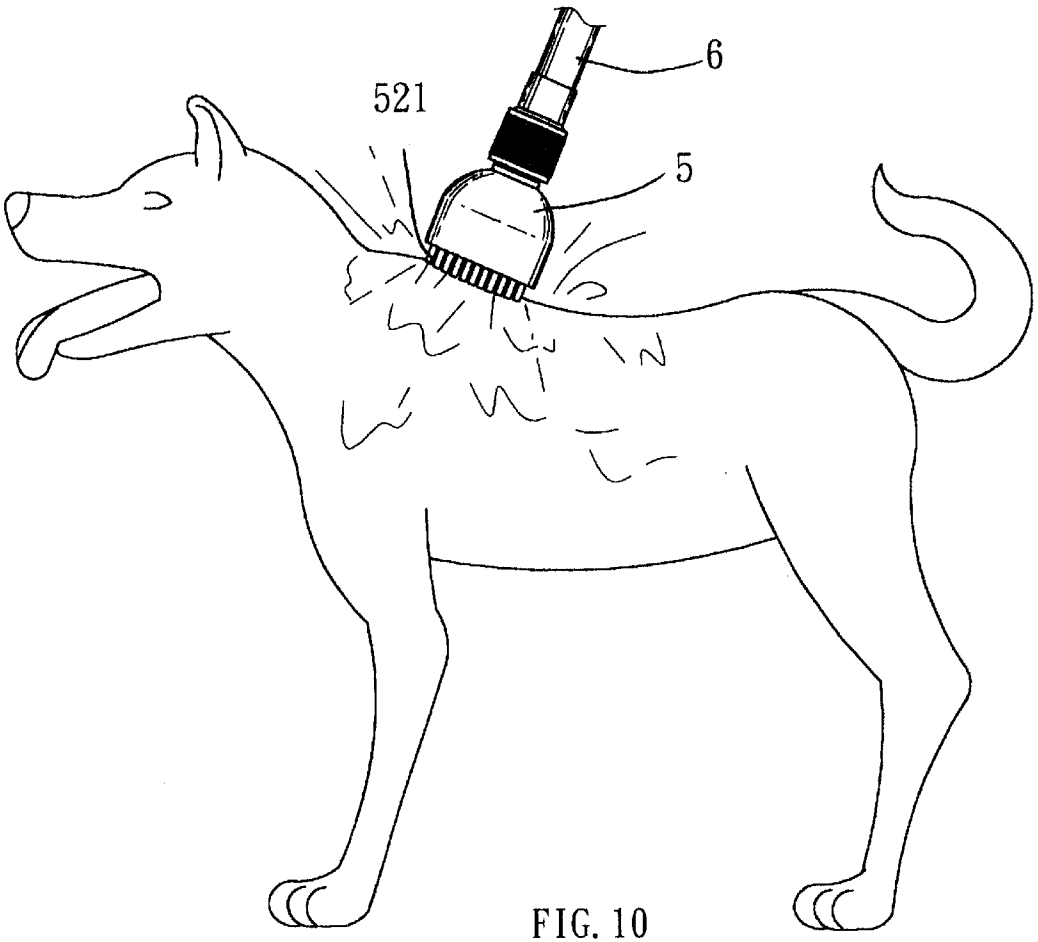
FIG. 10 is a schematic view illustrating operation of another embodiment of the present invention.

In addition, referring to FIG. 10, due to the posts 521 annularly provided on the spout plate 52, when water flows out of the spout plate 52 at the spout end of the spray head 5, it form fine water jets to thereby provide a larger spraying area. For instance, the posts 51 can serve as a comb to comb the hair when using the sprayer to wash a pet, thereby facilitating washing and combing of the hair of the pet. This advantage is absent in the spout of the prior art which is made from thin round aluminum plate and which is provided merely with water outlet holes.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A spout plate used in a spray head of a sprayer, the sprayer comprising: a spray head having a spout end at a front end thereof and provided with a retaining positioning groove and the spray head further having a spout plate, the retaining positioning groove enclosing an outer edge of a spout plate; a long tube having a top end connected to a bottom end of the spray head, and a handle connected to a bottom end of the long tube; characterized in that:

the spout plate is insertably secured to the spout end of the spray head and is made from one of slightly flexible rubbers and slightly flexible plastics material by integral injection molding, thereby, a plurality of posts defining distinct water guide channels are provided annularly on a spout surface thereof, a center of the spout plate is connected to a center of an interior of the spray head that is rotatably retractable and controllable;

whereby when the spout plate is insertably secured at the spout end at the front end of the spray head, and water flows through the interior of the spray head and out of the spray head through the spout plate to be sprayed out via the water guide channels of the posts provided on the spout plate, distinct water jets are sprayed out from the water guide channels to thereby provide an extensive spraying area and different effects; and whereby the spray head further comprises a hollow post-like flange centrally in a water intake end of the spray head and projecting inwardly; an opening of the flange being at a lower side of the spray head and another opening of the flange being facing toward the spout plate; the flange is provided with internal threads;

a connecting member having a hollow interior; a distal end of the connection member being centrally provided with a threaded hole; a distal section of the connection member having a periphery provided with a plurality of water outlet holes, and a middle section of the connection member having an outer periphery provided with external threads so as to cooperate with the flange at the center of the spray head to rotatably and retractably advance or retract, and a bottom section of the connection member is connected to a front-end of the long tube of the sprayer; and a bolt passing through the through hole in the center of the spout plate to be locked in the threaded hole in the center of the distal end of the connecting member such that rotatable retraction of the spray head can be utilized to cause the water ejected from the posts of the spout plate in distinct jets to provide an extensive spraying area and multiple effects.

2. The spout plate used in a spray head of a sprayer as claimed in claim 1, wherein the spout plate is directly and insertably secured at the spout end of a conventional spray head so that distinct water jets are sprayed out from the posts of the spout plate at the front end of the spray head after the sprayer is connected to a water source.

3. The spout plate used in a spray head of a spray as claimed in claim 1, wherein annular edges of top and bottom surfaces of the spout plate are respectively provided with annular flanges, and the retaining positioning groove in the spout end of the front end of the spray head faces the annular flange provided at the annular edge of the bottom surface of the spout plate; the retaining positioning groove is provided with an annular recess to enable the spout plate to be more effectively and insertably positioned on the spout end of the spray head.

* * * * *